US005699986A

United States Patent [19]

Welk

[11] Patent Number: 5,699,986

[45] Date of Patent: Dec. 23, 1997

[54] RAILWAY CROSSING COLLISION AVOIDANCE SYSTEM

[75] Inventor: James E. Welk, Killaloe, Canada

[73] Assignee: Alternative Safety Technologies, Whitney, Canada

[21] Appl. No.: 679,902

[22] Filed: Jul. 15, 1996

[51] Int. Cl.[6] ..... B61L 29/00

[52] U.S. Cl. ..... 246/125; 246/122 R; 246/126; 246/473.1; 340/902; 340/903; 340/904

[58] Field of Search ..... 246/122 R, 126, 246/125, 174, 176, 292 R, 293, 473.1; 340/901, 902, 903, 904

[56] References Cited

U.S. PATENT DOCUMENTS

| | | | |
|---|---|---|---|
| 3,777,139 | 12/1973 | Peel | 246/125 |
| 3,929,307 | 12/1975 | Geiger . | |
| 4,120,471 | 10/1978 | Auer . | |
| 4,723,737 | 2/1988 | Mimoun . | |
| 4,942,395 | 7/1990 | Ferrari et al. | 246/473.1 |
| 5,070,320 | 12/1991 | Ramono | 340/539 |
| 5,554,982 | 9/1996 | Shirkey et al. | 246/473.1 |

*Primary Examiner*—S. Joseph Morano
*Attorney, Agent, or Firm*—William R. Hinds

[57] ABSTRACT

With the vehicle anti-collision system of the present invention, road vehicles in the vicinity of a railway crossing are alerted as a train approaches the crossing. A signalling device operating in conjunction with a GPS receiver located in the train emits a signal to a receiver located at the railway crossing to provide an indication of the rail vehicle's location with respect to the railway crossing. The signal is sent continuously at predetermined intervals to provide the railway crossing with sufficient data to estimate the velocity and time of arrival of the train or railway vehicle at the crossing. The railway crossing processes the information and transmits an alarm signal to approaching road vehicles as the rail vehicle approaches the crossing. The signal emitted by the crossing is received at the road vehicle which provides various levels of alarms depending on how close the rail vehicle is to the crossing.

18 Claims, 3 Drawing Sheets

RAILWAY CROSSING COLLISION AVOIDANCE SYSTEM

FIELD OF THE INVENTION

This invention relates to anti-collision systems and more particularly to railway crossing collision avoidance systems.

BACKGROUND OF THE INVENTION

Railway crossings are inherently unsafe due to weather conditions, lack of attention by vehicle operators crossing the tracks and the fallibility of railway crossing signalling devices. Various systems have heretofore been designed to minimize problems associated with detecting an oncoming train approaching a railway crossing. Such systems are described in U.S. Pat. Nos. 3,929,307; 4,120,471 and 4,723,737.

Although each of these systems improves the reliability of detecting oncoming trains at railway crossings, studies have shown that motor vehicle operators will nevertheless try to beat the train at the railway crossing, or will simply be unaware of the flashing signal at the crossing.

In some cases, railway crossings and road traffic signals present vehicle operators with information which can place the vehicle in a dangerous location with respect to the railway crossing. For example, railway crossings are often located near traffic lights at an intersection. In most cases, the traffic signals and the railway crossing signals operate independently. Although traffic and road planners make an effort to place traffic signals at a safe distance from railway crossings, this is not always possible. Unfortunately, accidents have occurred at such location, wherein either a bus or a truck overhangs the railway crossing while stopped at a red light. This may also occur when traffic is backed-up at the traffic light and the last vehicle does not completely clear the railway crossing.

In some situations, two or more tracks may cross a highway with insufficient spacing between the tracks for a bus or truck to clear both tracks.

Whether accidents are caused by the inattention of the drivers, undesirable weather conditions or inadequate traffic planning, a railway crossing collision avoidance system is required which will reduce the likelihood of a railway crossing accident. Accordingly a need exists for a railway crossing collision avoidance system which can overcome the problems associated with the aforementioned prior art.

It is therefore an object of the present invention to provide a collision avoidance system for railway crossings in which a receiver located at the railway crossing is used to receive information from an oncoming railway vehicle which is indicative of the railway vehicle's velocity and time of arrival at the crossing.

Yet another object of the present invention is to provide a collision avoidance system for railway crossings in which the railway crossing is provided with a processor which makes use of the information received from the railway vehicle to establish an alarm condition as an oncoming railway vehicle approaches the railway crossing.

Yet another object of the present invention is to provide a collision avoidance system for railway crossings in which a transmitter located at the railway crossing emits an alarm signal directed to approaching road vehicles, which is indicative of how close the rail vehicle is to the crossing.

Yet another object of the present invention is to provide a collision avoidance system for railway crossings in which the alarm signal emitted by the railway crossing provides the operator of the vehicle with various levels of alarms depending on how close the rail vehicle is to the crossing.

Yet another object of the present invention is to provide a collision avoidance system for railway crossings in which the location of crossings can either be pre-stored on the rail vehicle's processor or transmitted from each crossing as the rail vehicle approaches each crossing.

SUMMARY OF THE INVENTION

With the system of the present invention, road vehicles in the vicinity of a railway crossing are informed of a train approaching the crossing. In a first embodiment of the invention, a signalling device located in the train emits a signal to a receiver located at the railway crossing to provide an indication of the rail vehicle's location with respect to the railway crossing. The signal is sent continuously at predetermined intervals to provide the railway crossing with sufficient data to estimate the velocity and time of arrival of the train or railway vehicle at the crossing. The railway crossing processes the information and transmits an alarm signal to approaching road vehicles if a potential collision is detected. The signal emitted by the crossing is received at the road vehicle which provides various levels of alarms depending on how close the rail vehicle is to the crossing.

In another embodiment of the invention, the train or railway vehicle derives a velocity and time of arrival of the train at an oncoming crossing. An alarm signal is emitted from a transmitter on the train so as to be received by approaching road vehicles. The location coordinates of the oncoming railway crossing from which the velocity and time of arrival of the train can be derived, is either pre-stored at a train's onboard processor or each railway crossing transmits its location coordinates to oncoming trains.

According to an aspect of the present invention, there is provided a railroad crossing collision avoidance system for alerting a road vehicle approaching a railroad crossing of an oncoming rail vehicle, comprising:

tracking means on said rail vehicle to determine said rail vehicle's position with respect to said railroad crossing;

transmitter means responsive to said tracking means for transmitting tracking data indicative of the location of said rail vehicle from said railroad crossing;

first receiver means at said railroad crossing for receiving said transmitted tracking data;

processor means at said railroad crossing for calculating the velocity and arrival time of said rail vehicle in response to said tracking data; and transmitter means at said railroad crossing responsive to said processor means for transmitting an alarm signal to an approaching road vehicle, said alarm signal being indicative of the velocity and time of arrival of a rail vehicle at said railroad crossing.

According to another aspect of the present invention, there is provided a railroad crossing collision avoidance system for alerting a road vehicle approaching a railroad crossing of an oncoming rail vehicle, comprising:

tracking means on said rail vehicle to derive tracking data indicative of said rail vehicle's position with respect to said railroad crossing;

storing means on said rail vehicle for storing locations of railroad crossings along a railway line travelled by said rail vehicle;

processor means on said rail vehicle for calculating the velocity of said rail vehicle and arrival time at said railroad crossing, in response to said tracking data; and first transmitter means responsive to said processor means for transmitting an alarm signal to an approaching road vehicle, said alarm signal being indicative of the velocity and time of arrival of a rail vehicle at said railroad crossing.

According to yet another aspect of the present invention, there is provided a method of alerting a road vehicle, approaching a railroad crossing, of an oncoming rail vehicle, comprising the steps of:

estimating said rail vehicle's position with respect to said railroad crossing;

transmitting said estimated position to said railroad crossing;

receiving said estimated position at said railroad crossing and calculating the velocity and an estimated time of arrival of said rail vehicle;

transmitting an alarm signal to road vehicles approaching said railroad crossing when said rail vehicle is at a predetermined distance from said rail crossing; and emitting an alarm at said road vehicle when said alarm signal is received thereat to alert the road vehicle operator of a potential collision with said rail vehicle at said rail crossing.

DESCRIPTION OF THE PREFERRED EMBODIMENT

Figure 1:
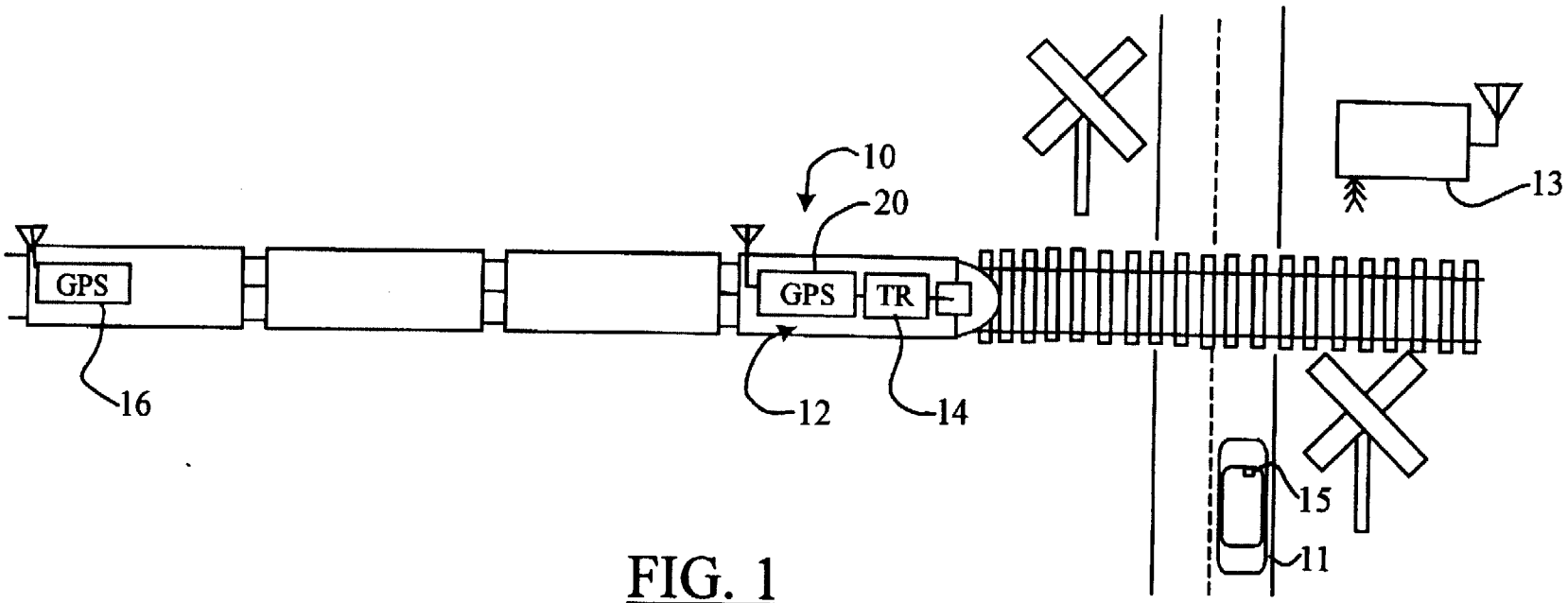
FIG. 1 is a diagram illustrating the railway crossing collision avoidance system of the present invention.

Referring now to FIG. 1, we have shown a diagram illustrating the main components forming part of the railway crossing collision avoidance system of the present invention. Although in a preferred embodiment, the collision avoidance system is described in relation to the prevention of collisions between a train and a vehicle approaching the railway crossing, it should be noted that the system is also applicable to any 'rail-road' crossing wherein a risk of collision between a rail and road vehicle exists. For example, at locations where public transit rail vehicles cross highways and roads.

In FIG. 1, we have shown a rail vehicle 10, such as a train, approaching a railway crossing which is also being approached by a road vehicle 11. A signalling device 12 located at the front end of the train 10 emits a signal to a crossing monitor 13 located at the railway crossing. The signalling device 12 is comprised of a Global Positioning System (GPS) receiver adapted to acquire a locator signal emitted from a geostationary satellite. Today's commercial GPS receivers offer very good positioning accuracy which can provide the absolute position of a train relative to a railway crossing which is in a fixed position. The signalling device 12 is also comprised of a signal transmitter 14 which transmits a signal to the railway crossing monitor 13. This signal is transmitted continuously as the train travels along the track. The signal will contain information or coordinates indicative of the location of the train with respect to the data received from the geostationary satellite. At the railroad crossing monitor 13, a determination of the distance can instantaneously be derived since the railway crossing is at a known fixed location. Another GPS receiver (not shown) can be provided at the crossing monitor 13 to determine the location of the crossing. The latitude and longitude of the crossing can of course be programmed in advanced either at the train's onboard processor or can be transmitted to oncoming trains for use in estimating the train's distance from the crossing. Similarly, as the signal is received from the signalling device 12, the velocity of the train can also be determined.

Depending on the speed of the train, the arrival time of the train at the crossing can be estimated. If the train slows down, the arrival time is increased whereas if the train speeds up, the arrival time is decreased. From this information, an alarm condition can be derived at the railroad crossing monitor 13. The alarm condition will vary according to the time of arrival of the train as well as its velocity. Thus, various alarm levels can be provided according to the location and speed of an incoming train. Once the monitor 13 processes the information received from the train 10, a transmitter (not shown) located at the monitor 13 will emit an alarm signal to any oncoming road vehicle, such as road vehicle 11. The type of alarm signal can vary according to the warning level required. Thus, if the train is at a fair distance from the railroad crossing or is slowly approaching the crossing, an alarm with a lower warning level will be transmitted to oncoming vehicles. On the other hand, if the train is approaching at a high speed, an alarm with a higher warning level will be transmitted. An alarm signal receiver 15 located at vehicle 11 will trigger an audio and visual alarm to let the vehicle operator know that an oncoming train is approaching the railway crossing. A low level alarm signal would, for example, light up a yellow or amber LED and a corresponding chirp would be emitted from receiver 15. If the train 10 is arriving at a high speed and is located near the crossing, a high level alarm signal would be transmitted to the receiver 15. This high level alarm would trigger red LEDs and a higher pitch or louder chirp would be emitted to alert the road vehicle operator of a potential collision at the railway crossing.

The operation of the railway crossing anti-collision system is preferably independent of existing railroad crossing signals. In addition to the time of arrival of the train at the crossing, the time to clear the crossing is also an important factor since the time to clear the crossing will vary according to the number of wagons comprising the train as well as the velocity of the train. For very long trains, a second GPS receiver 16 is provided at the last wagon. This additional GPS receiver enables the system to determine when the alarm condition should change in accordance with the time to clear the crossing. In addition, it also assists in preventing accidents caused when trains are put in reverse once they have passed the crossing.

The train's distance from the crossing is estimated by using the train's GPS value minus the crossing's position multiplied by a topology factor. The train's velocity is calculated according to the time taken between two readings of the train's position. The arrival time of the train at the crossing can therefore be derived from the train distance and train velocity.

Once the alarm is emitted at receiver 15 of vehicle 11, the receiver can be reset by the vehicle operator so as to provide feedback to ensure that the signal was recognized.

By calculating the train's velocity and distance from the crossing, the anti-collision system of the present invention can be used to determine or discern the difference between an idle train, an approaching train, and a departing train.

Figure 2:
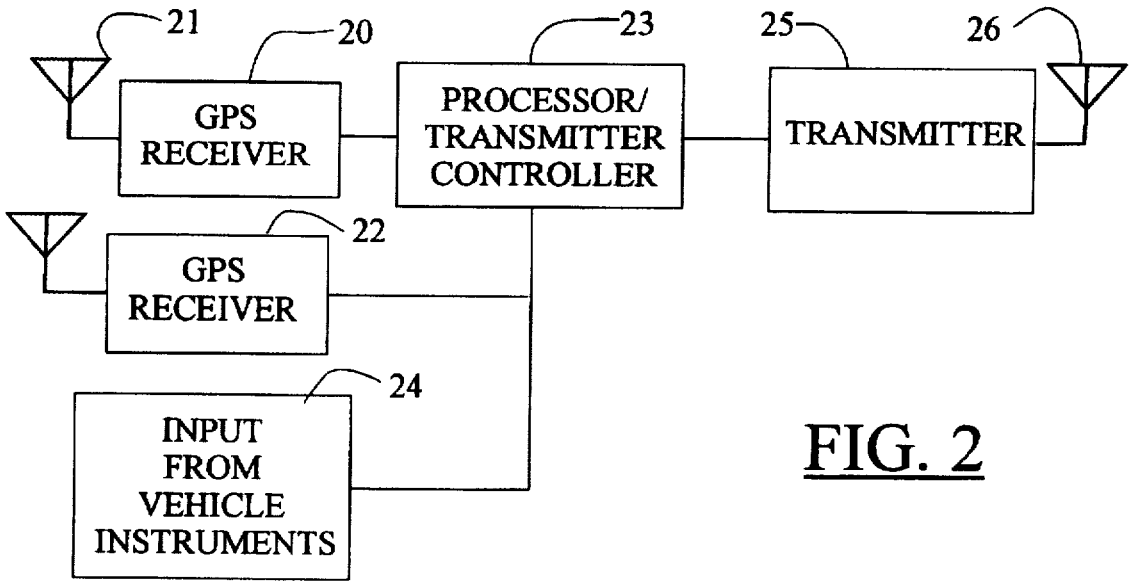
FIG. 2 is a block diagram of the rail vehicle positioning systems.

FIG. 2 is a block diagram of the signalling device 12 located onboard the train as shown in FIG. 1. As indicated previously, the train is equipped with a first GPS receiver 20 located at the front of the train. A GPS antenna 21 can be disposed anywhere near the GPS receiver as long as it is capable of providing an adequate signal to the receiver. A second GPS receiver 22 can be provided at the end of the train for reporting the train's position on a continuous basis at predetermined intervals. GPS Receivers placed at either end of the train and coupled to a processor/controller 23 provide the global absolute position of both ends of the train.

In one embodiment of the present invention, processor/controller 23 acquires the GPS information from receivers 20 and 22 and will calculate the velocity of the train. Optionally, the processor/controller 23 can compare the calculated velocity with input from the train's instruments 24. The velocity calculated by the processor/controller 23 and the velocity obtained from the train's instruments 24 will differ due to track geometry. That is, the train's instruments will indicate the velocity of the train over the track, whereas the processor/controller 23 will derive a velocity based on the time taken by the train to cover the distance between two points. The information calculated at the processor/controller 23 is then formatted for transmission via a transmitter 25. The transmitter 25 will code and transmit the data over antenna 26 to monitors located at the railroad crossings. The transmitter in the train will transmit the signal at a relatively wide angle to any crossing monitor located within its range. Each transmitter is equipped with RF transmitters that operate on different sideband frequencies to eliminate potential interference with other trains in the vicinity. The range of the signal from the transmitter 25 will take into effect the minimum time to clear the track which is calculated from the maximum velocity of the approaching train. A value of, say, five minutes can be provided. The coded signal from transmitter 25 contains the absolute position of the train (both ends) based on the received GPS readings. The transmitter 25 transmits the signal continuously with a new position update at intervals of at least every 30 seconds. The message is continuously repeated to eliminate signal loss due to terrain or other signal loss conditions. The RF transmission from the transmitter 25 is at a high enough frequency to prevent interference from weather conditions, track bends or angles of approach to the crossing. Using the GPS signal, the train's position is available to an accuracy of approximately 30 meters. If the train is stalled or halted, the signal containing the same position measurements will be repeated continuously. Trains backing up will have a negative velocity measurement. The position of the train's last wagon will be known based on the signal relayed from the second GPS receiver 22.

In a second embodiment, the data captured by the GPS receivers 20 and 22 are coded and transmitted by transmitter 25 to the crossing monitor located at the railroad crossings. In this embodiment, the railroad crossing monitor determines the position and velocity of the train from the transmitted data. Thus, depending on which embodiment is considered to be more suitable, calculation of the velocity of the train can either be completed at the processor controller 23 onboard the train as described above or at the monitor 13 located at the railroad crossing.

In a further embodiment, the train or railway vehicle derives a velocity and time of arrival of the train at an oncoming crossing. An alarm signal is emitted from a transmitter on the train so as to be received by approaching road vehicles. The location coordinates of the oncoming railway crossing from which the velocity and time of arrival of the train can be derived, is either pre-stored at a train's onboard processor or each railway crossing transmits its location coordinates to oncoming trains.

Figure 3A:
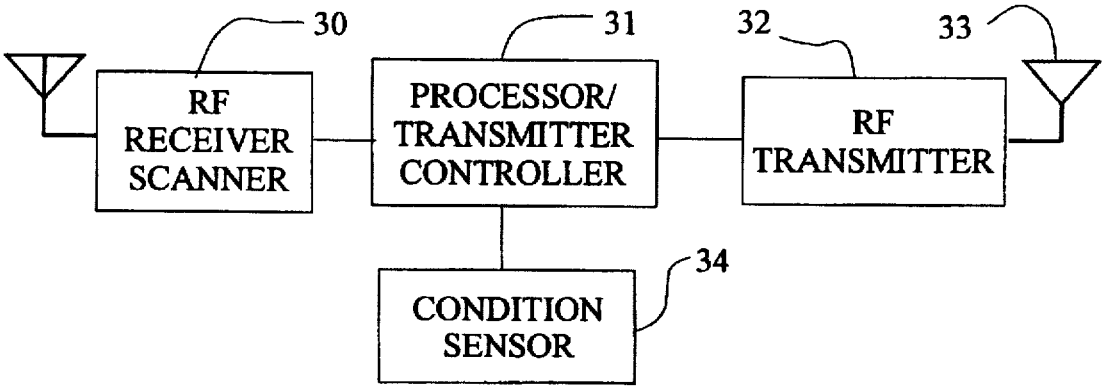
FIG. 3*a* is a block diagram of the railway crossing monitor.

A block diagram of the monitor 13 located at the railroad crossing is shown in FIG. 3*a*. The RF signal received from the oncoming train is first scanned by an RF receiver/scanner 30 to determine the proper carrier frequency of the incoming signal. The processor/controller 31 will, as described in the first or second embodiment described above, calculate the train's position and velocity based on the data received from the GPS receivers located on the train. The position of the crossing can either be obtained from another GPS receiver (not shown) located at the crossing or entered in the processor/controller 31. Based on this information, the processor/controller 31 will determine whether an alarm condition exists. If an alarm condition exists, a determination of what level of alarm to be transmitted to road vehicles is then determined. Once the alarm condition level is determined, an RF transmitter 32 is used to code and transmit an alarm signal via antenna 33 to approaching road vehicles. A secondary back-up power source can be provided in the event of a power failure. The alarm signal transmitted at antenna 33 contains a time stamp which provides information for future reference should a crossing incident occur.

Figure 3B:
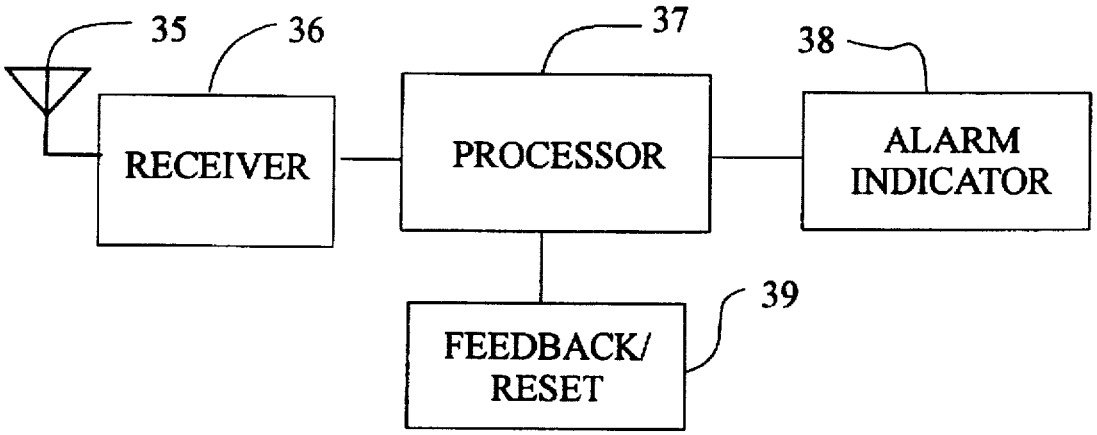
FIG. 3*b* is a block diagram of the road vehicle receiver.

Referring now to FIG. 3*b*, we have shown a block diagram of a low-cost receiver for use in a road vehicle in conjunction with the anti-collision alarm system of the present invention. The road vehicle receiver basically consists of a receiving antenna 35 connected to an RF receiver 36. The incoming signal is processed by processor 37 to determine the level of alarm being received. The alarm indicator 38 may comprise an audible alarm which is activated as soon as the alarm condition is received, regardless of its level. It may also include one or more visual indicators such as a flashing lights or LEDs which may be of different colours according to the level of alarm being transmitted from the railroad crossing monitor 13. A feedback or reset key 39 can be provided in order to provide feedback to the system that the vehicle operator has recognized the signal. The vehicle receiver may optionally store a time stamp transmitted at the railroad crossing to provide an indication of the timing information of the crossing signal. The timing information would, for example, contain the time at which the operator provided an acknowledgement as well as the time the train arrived at the crossing. A memory (not shown) may be provided to store a number of crossing events such as the level of alarm received by the vehicle receiver.

In addition to determining the alarm level based on the velocity and time of arrival of the train at the crossing, the railroad crossing monitor 13 can also be provided with a sensor 34 to modify the alarm level according to the weather condition existing at the crossing as the train approaches. For example, in weather conditions which make the arrival of a train or the crossing signals difficult to see by the operator of an approaching vehicle. This could occur if the immediate vicinity of the crossing is experiencing fog conditions, heavy snowfall or other difficult weather conditions. A higher alarm condition could be triggered by the railroad crossing monitor, if those conditions should occur. The audible or visual alarm signal would enable the operator of the vehicle to be alerted sooner especially when road conditions can affect the time necessary for the operator to slow down before the crossing. In addition, the risk of a collision at crossings located near traffic signals would be significantly reduced since the operator of the vehicle would receive an indication of an incoming train, well in advance of the crossing.

Preferably, the vehicle receiver should be installed in all school and public transit buses. Similarly, low-cost receivers could be installed on all road vehicles either during manufacture or by after-market equipment suppliers. In addition, receivers could also be incorporated as part of standard AM/FM radios installed in road vehicles. The alarm receiver would be such as to operate independently of the car radio.

I claim:

1. A railroad crossing collision avoidance system for alerting a road vehicle approaching a railroad crossing of an oncoming rail vehicle, comprising:

tracking means on said rail vehicle to determine said rail vehicle's position with respect to said railroad crossing;

transmitter means responsive to said tracking means for transmitting tracking data at a unique radio frequency carrier, said tracking data being indicative of the location of said rail vehicle from said railroad crossing;

first receiver means comprised of a multi-frequency scanner at said railroad crossing for receiving said transmitted tracking data from one or more of said rail vehicles;

processor means at said railroad crossing for calculating the velocity and arrival time of said rail vehicle in response to said tracking data; and transmitter means at said railroad crossing responsive to said processor means for transmitting an alarm signal to an approaching road vehicle, said alarm signal being indicative of the velocity and time of arrival of a rail vehicle at said railroad crossing.

2. A system as defined in claim 1, wherein said tracking means comprises a global positioning system (GPS) receiver.

3. A system as defined in claim 2, wherein said rail vehicle comprises a multi-wagon train with a GPS receiver located at each end of said multi-wagon train.

4. A system as defined in claim 3, wherein said tracking data is transmitted continuously at periodic intervals to said first receiver means.

5. A system as defined in claim 4, wherein said tracking data is further comprised of a time stamp.

6. A system as defined in claim 1, further comprising a second receiver means at said road vehicle for receiving said alarm signal in order to alert an operator of said road vehicle of a potential collision with a rail vehicle, at said railroad crossing.

7. A system as defined in claim 6, wherein said second receiver means is comprised of an audio and video signalling device responsive to said alarm signal.

8. A system as defined in claim 7, wherein said second receiver means is further comprised of a reset key to reset said audio and video signalling device.

9. A system as defined in claim 8, wherein said second receiver means is comprised of a memory for storing information on said alarm signal received at said second receiver means.

10. A railroad crossing collision avoidance system for alerting a road vehicle approaching a railroad crossing of an oncoming rail vehicle, comprising:

tracking means on said rail vehicle to derive tracking data indicative of said rail vehicle's position with respect to said railroad crossing;

storing means on said rail vehicle for storing locations of railroad crossings along a railway line travelled by said rail vehicle;

processor means on said rail vehicle for calculating the velocity of said rail vehicle and arrival time at said railroad crossing, in response to said tracking data; and first transmitter means responsive to said processor means for transmitting an alarm signal to an approaching road vehicle, said alarm signal being indicative of the velocity and time of arrival of a rail vehicle at said railroad crossing; and second transmitter means at said railroad crossings for transmitting its location to each oncoming rail vehicle, as said rail vehicle travels along said railway line.

11. A system as defined in claim 10, wherein said tracking means comprises a global positioning system (GPS) receiver.

12. A system as defined in claim 11, wherein said rail vehicle comprises a multi-wagon train with a GPS receiver located at each end of said multi-wagon train.

13. A system as defined in claim 12, wherein said first transmitter means is located at each railway crossing so as to transmit an alarm signal to said approaching road vehicles in response to the velocity and time of arrival data received from said rail vehicle.

14. A system as defined in claim 13, wherein said velocity and time of arrival data is transmitted continuously at periodic railway crossings from an approaching rail vehicle.

15. A system as defined in claim 14, wherein velocity and time of arrival data is transmitted from each rail vehicle on a unique radio frequency carrier.

16. A system as defined in claim 15, wherein each railway crossing is further provided with a multi-frequency scanner to receive velocity and time of arrival data from different rail vehicles.

17. A system as defined in claim 10, further comprising second receiver means at said road vehicle for receiving said alarm signal in order to alert an operator of said road vehicle of a potential collision with a rail vehicle, at said railroad crossing.

18. A system as defined in claim 17, wherein said second receiver means is comprised of an audio and video signalling device responsive to said alarm signal.

* * * * *